United States Patent [19]

Mainiero et al.

[11] Patent Number: 4,484,729

[45] Date of Patent: Nov. 27, 1984

[54] BARRIER COIL DISPENSER

[75] Inventors: Joseph J. Mainiero, Hauppauge, N.Y.; Michael R. Mainiero, Monroe; Arthur T. Stanley, Shelton, both of Conn.

[73] Assignee: Man Barrier Corporation, Seymour, Conn.

[21] Appl. No.: 340,517

[22] Filed: Jan. 18, 1982

[51] Int. Cl.[3] ..... E04H 17/00

[52] U.S. Cl. ..... 256/1; 256/2; 242/86.6

[58] Field of Search ..... 256/2, 5, 6, 9, 1; 242/129, 86.6

[56] References Cited

U.S. PATENT DOCUMENTS

| | | | |
|---|---|---|---|
| 3,070,946 | 1/1963 | Kirsch et al. | 256/2 X |
| 3,155,374 | 11/1964 | Sieffert | 256/2 |
| 3,199,807 | 8/1965 | Kirsch et al. | 242/129 |
| 3,463,455 | 8/1969 | Meckel | 256/8 |
| 4,040,603 | 8/1977 | Mainiero | 256/8 |
| 4,208,021 | 6/1980 | Wall | 242/129 X |

FOREIGN PATENT DOCUMENTS

| | | | |
|---|---|---|---|
| 603941 | 10/1934 | Fed. Rep. of Germany | 256/2 |
| 862100 | 11/1940 | France | 256/6 |
| 841415 | 7/1960 | United Kingdom | 256/2 |
| 1221178 | 2/1971 | United Kingdom | 256/2 |

*Primary Examiner*—Andrew V. Kundrat

*Attorney, Agent, or Firm*—Hayes & Reinsmith

[57] ABSTRACT

An entanglement barrier coil dispenser is disclosed wherein a frame supports a coil dispensing drum. The drum is designed to house a coil preliminary to its deployment, for example, as an anti-personnel barrier. The coil is extensible and retractable about its central axis between stretched and collapsed conditions and when housed within the drum is in collapsed condition coaxially aligned with a drum central axis. The frame in the specifically disclosed embodiment has a pair of skids for sliding surface movement upon vehicular towing, e.g., of the frame. The drum is supported for rotation on the frame whereby torsional stress within the coil during its deployment is automatically relieved to assure a desired obstacle emplacement without coil buckling.

15 Claims, 13 Drawing Figures

BARRIER COIL DISPENSER

FIELD OF THE INVENTION AND CROSS REFERENCE TO RELATED ART

This invention generally relates to entanglement coil barrier dispensers and particularly concerns a dispenser for deploying or stretching such a coil, housed within the dispenser, from a collapsed, nested condition into a generally cylindrical obstruction for use, e.g., as an anti-personnel barrier. The dispenser of this invention is particularly suited for coil deployment along a desired barrier zone or trace with a predetermined maximum length and minimum diameter for rapid interference-free deployment without coil buckling. The coil with which the dispenser of this invention is particularly useful is fully disclosed and described in U.S. patent application Ser. No. 340,516, filed Jan. 18, 1982, entitled Extensible and Retractable Barrier and assigned to the assignee of this invention.

SUMMARY OF THE INVENTION

To assure deployment of an extensible barrier coil from a retracted, collapsed condition along a predetermined barrier trace without coil buckling or rolling along the ground surface, a dispenser of this invention has been designed to accommodate torsional stress imparted to the coil during deployment. More specifically, the dispenser of this invention is particularly suited to payout a barrier coil (of the type described in the referenced U.S. patent application Ser. No. 340,516 ) from an initially retracted, collapsed stack of closed coil turns forming a solid cylinder, into a stretched condition of a preselected maximum length and minimum uniform diameter. The dispenser features a coil housing drum rotatably supported on a frame, which is adapted to be towed behind a vehicle for emergency emplacement with minimum delay, and which drum is rotatable during such emplacement to ensure buckle -free emplacement along a predetermined barrier trace.

Other details, objects and advantages of this invention will become apparent as the following description of a presently preferred embodiment of practicing the same proceeds.

DETAILED DESCRIPTION OF A PREFERRED EMBODIMENT

Figure 1:
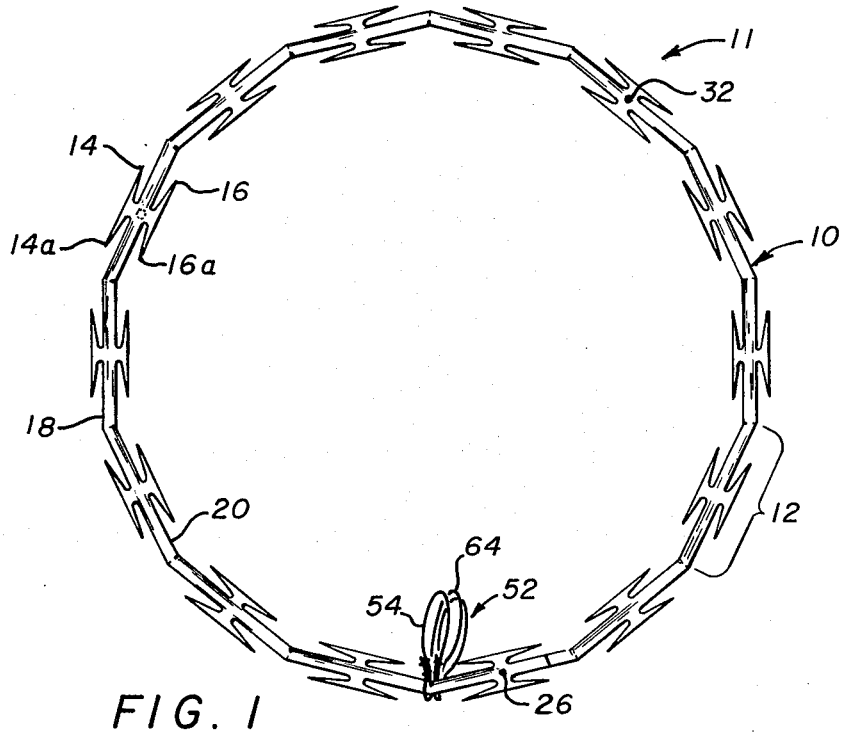
FIG. 1 is an end view of a barrier coil particularly suited to be deployed by the dispenser of this invention.
Figure 2:
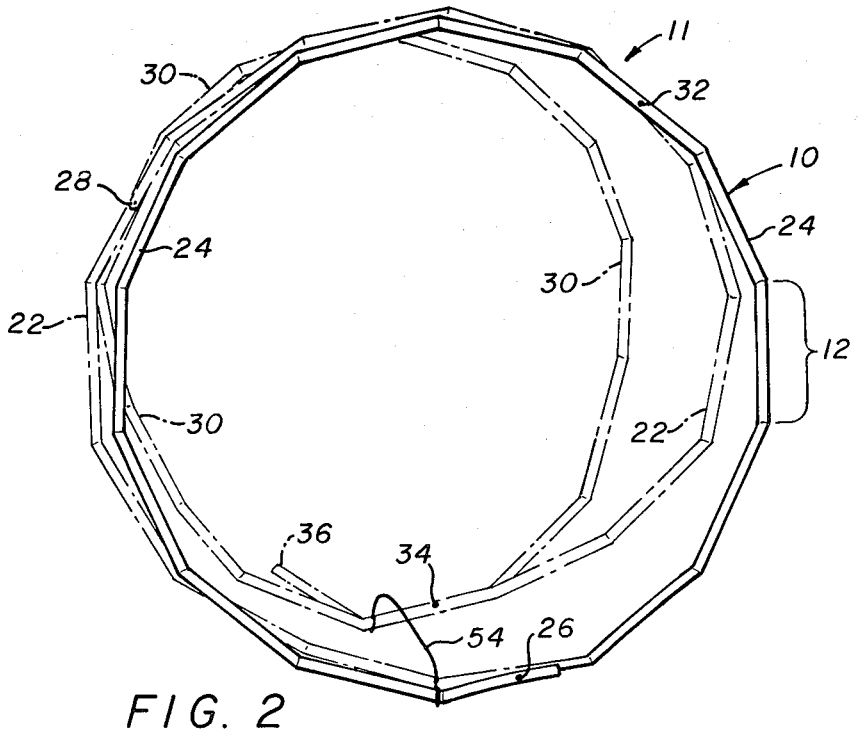
FIG. 2 is a view of the coil of FIG. 1 which has certain parts removed for clarity and shows two turns of the coil adjacent its end coil in offset relation to one another for purposes of illustration.

Barbed tape 10 is illustrated which will be understood to be of a type fully described in the above note U.S. patent application Ser. No. 340,516. Tape 10 is fabricated from linear, substantially planar, flat metal strip stock. Tape 10 has a continuous series of closed loops or turns normally defining a helical coil 11 with each closed turn preferably having adjoining equally angularly offset linear segments of equal length such as at 12 (FIGS. 1 and 2). Each turn of coil 11 is so formed as to be readily retracted into stacked confronting, nesting, collapsed relation to its adjoining connected turns.

Tape 10 preferably is constructed with identical barb clusters each having four needle-sharp barbs with each four-barb cluster having two-barb pairs 14, 14*a* and 16, 16*a* spaced opposed along opposite tape edges 18 and 20 (FIGS. 1, 7 and 9), and the plane of the tape 10 will be understood to contain the longitudinally extending outside and inside tape edges 18 and 20. For example, each barb pair may be, say, 2.375 inch long and equally spaced apart on about four inch centers repeatedly along the length of tape 10 dimensioned, e.g., to be 0.025 inch thick and about 1.195 inch wide at the maximum width of the tape across barbs and fabricated for general purpose use, say, with 24 and 30 inch diameter turns. Such tape may be fabricated from flat strip stock of high carbon steel and is particularly suited to be formed from austenetic stainless steel 0.025 inch thick, e.g., hardened to Rockwell 30 N, 50–70.

The barb clusters are positioned in precise corresponding relation to one another along each turn of coil 11 such that linear segments 12 and their barb clusters of each closed turn of the coil may be positioned in face-to-face contact engagement with corresponding elements of their connected adjacent turns throughout their entire length when the turns are retracted to nest in an axially aligned arrangement.

The strip is initially formed with oriented barbs, and the strip is then edge bent in the plane of the tape 10 to form it into identical adjoining linear segments 12 whereby a substantially identically constructed succession of angularly off-set linear tape segments 12 are ensured. Thus, a uniformly controlled stacking of the turns of coil 11 in collapsed compact condition is obtained to ensure that the correspondingly spaced barb clusters are nested in face-to-face contact engagement with correspondingly aligned confronting clusters of the adjoining connected turns of coil 11. As illustrated in FIG. 1, each barb cluster is formed intermediate the ends of its respective linear tape segment 12 at a point midway between its ends to ensure the desired precision stacking of successive turns of the coil in a collapsed condition.

While the material and the details of the coil have been described with specific reference to the preferred illustrated embodiment, it is to be understood that the coil may be formed of any material combining the required properties of producibility, extensibility, retractibility and structural strength required for obstruction and obstacle functioning. It is contemplated that, in addition to metal, other materials such as plastics are capable of being employed. Moreover, other specific basic entanglement constructions may be utilized such as a single coil concertina, e.g., with barbed metal tape fitted around a spring steel core wire.

To provide a barrier which can be readily recovered for repeated use and which is particularly suited for rapid deployment under emergency conditions and is thereafter retractable for re-use into a compact nested, collapsed stack in a facile manner, the barrier coil 11 features rigid and permanent point attachments of each intermediate coil turn, between the end turns, to adjacent trailing and leading coil turns in circumferentially spaced succession about each such intermediate coil turn. Preferably, these points of attachment comprise an odd number of approximately equiangularly spaced points throughout each intermediate coil turn of 360°. Such construction, when coupled with the previously described oriented protrusions (which are constructed to avoid any mutual interference) positively insures that precision orientation is maintained even upon coil deployment, whereby any relative longitudinal movement or slipping or twisting of the adjacent coils at their points of attachment is prevented.

Figure 3:
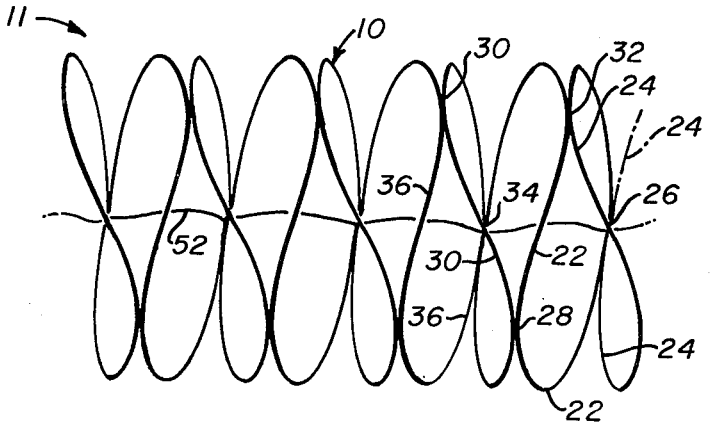
FIG. 3 is a top view of the coil of FIG. 1, on a reduced scale, shown in a stretched condition.
Figure 4:
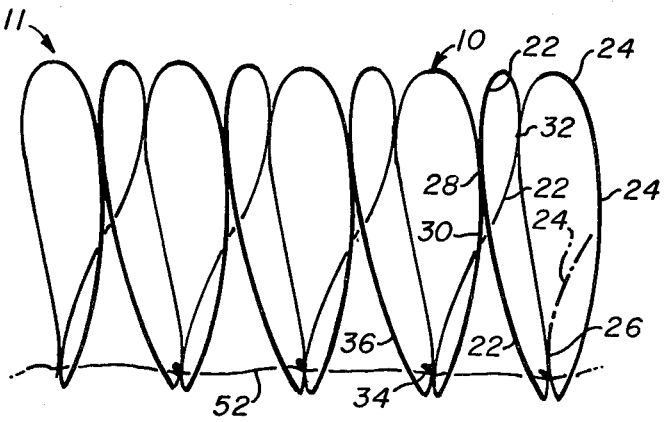
FIG. 4 is a side view of the coil of FIG. 3.

More specifically in reference to FIGS. 2–4, a first intermediate coil turn 22 (in leading relation to end turn 24 and described in FIGS. 3 and 4 from right to left) has an initial base point of attachment 26 to trailing end turn 24, a second point of attachment 28 to a leading intermediate coil turn 30 and a third point of permanent attachment 32 to trailing end turn 24 prior to the next circumferentially successive base point of attachment 34 of intermediate coil turn 22 to leading intermediate coil turn 36. Coil 36 and successive connected intermediate coil turns are likewise each alternately permanently attached to adjacent leading and trailing turns at spaced points throughout the coil length.

While different adjacent coil attachment devices and means may be used, FIGS. 7–10 show two specific means of adjacent coil attachment which have been found to provide satisfactory results in rapid and repeated emplacement and recovery of a coil unit of the type described.

Figures 7, 8:
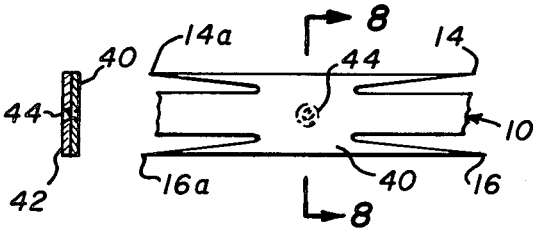
FIG. 7 is an enlarged plan view, partly broken away, showing a portion of a coil useable with this invention.
FIG. 8 is a cross-sectional view taken generally along line 8—8.
Figures 9, 10:
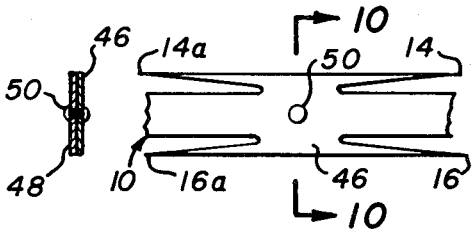
FIG. 9 is an enlarged plan view, partly broken away, showing a portion of another coil useable with this invention.
FIG. 10 is a cross-sectional view taken generally along line 10—10 of FIG. 9.

In the specific illustrations of adjacent point coil attachments illustrated in FIGS. 7 and 8, adjacent coil turns 40, 42 are illustrated as being spot welded at point 44, preferably at the center of confronting aligned barb clusters of the adjacent coil turns 40, 42. In FIGS. 9 and 10, adjacent coil turns 46, 48 are likewise rigidly and permanently secured to one another by a rivet 50 at the midpoint of the confronting barb clusters of turns 46, 48.

The number of points of rigid permanent attachment between adjacent coil turns may be varied depending upon whether the barrier provided is to be used for animal or human control purposes, as well as upon the desired size of the coil diameter when deployed and the like. Preferably, an odd number of permanent attachment points are employed for each coil turn. Examples of the number of attachment points which have been found to provide satisfactory results have ranged from three attachment points for each 360° turn for a collasped coil 11 having an approximately 18 inch diameter to, say, nine attachment points for a 360° coiled turn for a 48 inch collapsed diameter coil. Since each of the adjacent turns are absolutely secured in fixed relation to one another at their points of attachment, precise nesting of coil 11 has been found to be assured.

Figure 5:
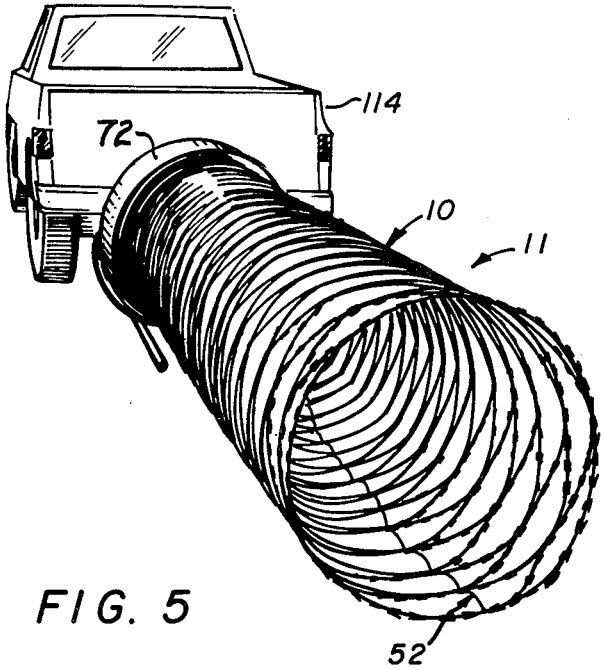
FIG. 5 is a perspective view of a barrier coil of this invention being deployed from a dispenser of this invention which is towed by a vehicle.

To control the maximum length of an obstacle upon extending or deploying coil 11 and to insure a deployed coil minimum diameter whereby a continuous length of the strip material, even when stretched, exhibits a relatively uniform radius of curvature, a relatively stiff spacer device 52 may be provided (FIG. 11) to extend along the base of the cylindrical coil to be formed upon deployment (FIG. 5). In the specifically illustrated embodiment, the spacer device 52 extends longitudinally along the length of coil 11 at matching points between turns, preferably adjacent the above described points of permanent attachment between turns.

The spacer device should have sufficient strengh and flexibility to provide repeated extension and retraction while bearing required obstacle dispensing loads. Such construction additionally necessitates a relatively stiff spacer to minimize any potential deflection and consequent undesired entanglement with adjacent spacer devices 52 or with any coil protrusions (such as the illustrated barbs) to insure that the full and appropriate length of the extended barrier coil 11 is realized.

Figure 11:
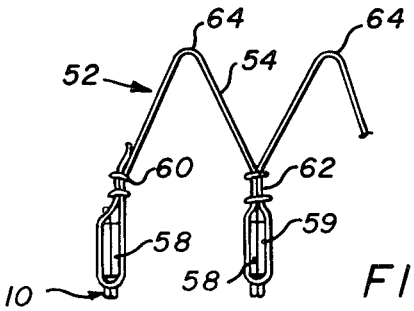
FIG. 11 is a side view, with certain parts removed for clarity, showing details of a spacer mechanism between successive corresponding points of the coil.

One spacer device 52 which has been used with success comprises thin metal lengths of strap with opposite ends fixed between coil turns and having a substantially rectangular cross section with a width to thickness ratio established, say, at about 24 to 1. In FIG. 11, an alternative to providing a spacer strap is illustrated which also provides the requisite stiffness to insure that the spacer device controls coil turn separation and yet does not deflect or tangle with adjacent spacer devices and/or coil protrusions. In FIG. 11, the spacer device or mechanism is formed by using a wire rope 54 such as 0.1875 inch diameter aircraft cable encased in a thin plastic jacket and secured adjacent the points of permanent attachment between coil turns 56, 58 and 58, 59 by fittings such as at 60, 62. It will be understood that the lengths of the jacketed aircraft wire rope cable 54 extending between fittings 60, 62 are approximately equal and secured at matching points successively along the length of coil 11 to control its maximum length and minimum diameter. The plastic jacket encasing the cable 54 serves to readily accept a "set" or memory to cable 54 without undesirably increasing the overall diameter of the cable assembly. Upon collapsing of coil 11, the memory of the aircraft cable 54 or wire rope assembly, which memory is preselectively established, serves to loop each length of spacer wire 54 about an intermediate bend zone 64 (FIG. 11) so as to be located in an interference-free folded position on the interior of the coil when collapsed (FIG. 1).

By virtue of the described coil turn spacer device and permanent attachment means between adjacent coil turns, the resulting obstacle barrier has been found to provide an erected obstruction of consistently uniform integrity such that the maximum length of a single barrier unit which may be installed has been significantly increased. The disclosed barrier coil 11 in fact has been found to be useful in a variety of different emplacement techniques which in turn suggests a need for compatible means of deployment. Such techniques include gravity drops, wherein the barrer coil 11 may be disposed with its central axis vertically aligned and suspended in collapsed or retracted condition to be released when desired along a vertical trace or zone to be obstructed, and high speed vehicular emplacement along a horizontal trace.

However, as the radius of curvature (of the coil turns) is reduced during deployment responsive to the extensible coil material being stretched, it has been found that coil 11 will normally rotate about is central axis about a 70° to 80° angular displacement for about every 50 feet of deployed coil to relieve torsional stress in the coil material developed during its emplacement. If this stress is not accommodated, the barrier coil 11, once deployed, will automatically relieve such torsional stress by an undesired spontaneous buckling or rolling along the ground surface, e.g., resulting in an undesired barrier curvature at periodic intervals which departs from the desired barrier trace.

Figure 12:
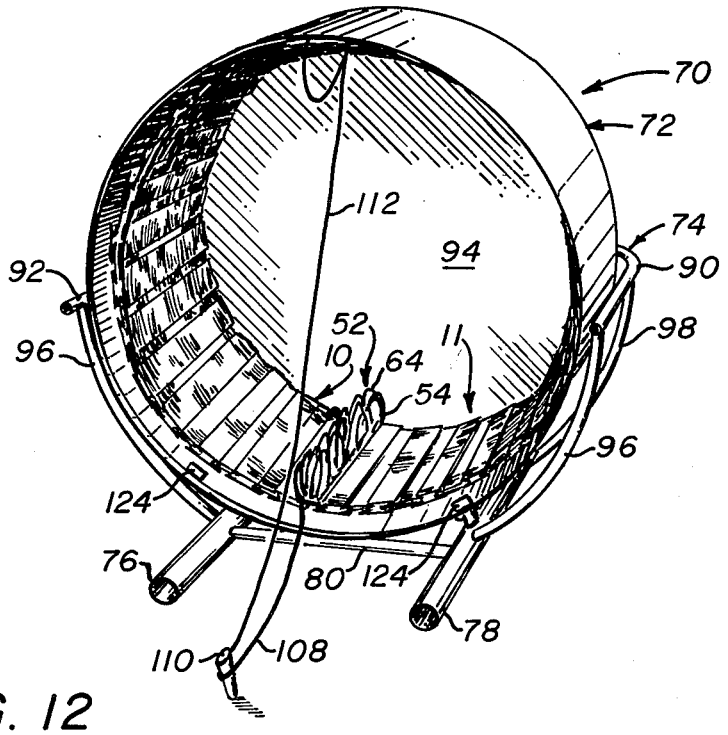
FIG. 12 is an isometric view of the barrier coil in a collapsed, or retracted, ready condition within the dispenser of this invention particularly suited for rapid deployment of the coil.
Figure 13:
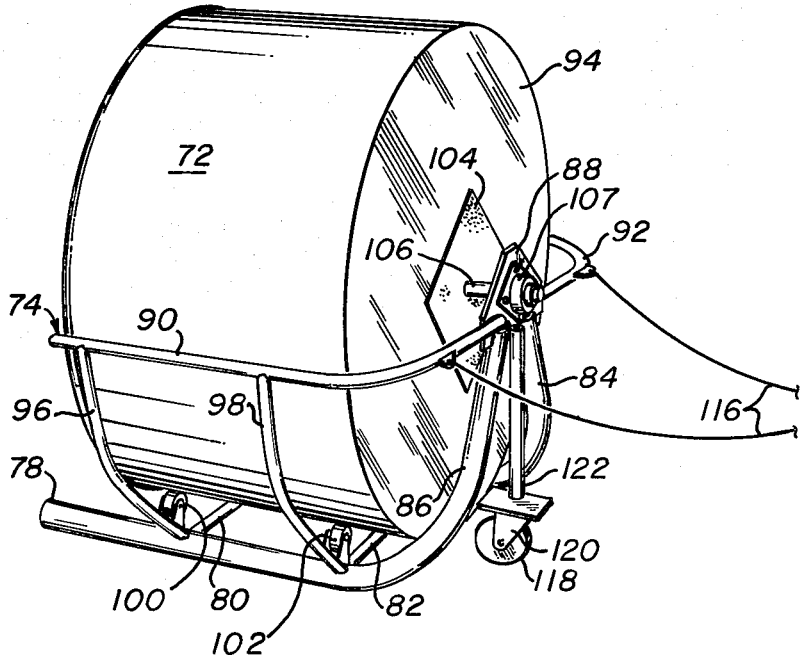
FIG. 13 is an isometric view of the dispenser of FIG. 12 showing a closed end of the dispenser.

To minimize such undesired displacement of the coil turns from a uniform cylindrical configuration upon installation and thereby assure uniformity of the emplaced obstacle, even when a continuous, single barrier unit length is say, 2000 feet or more, without buckling of the barrier or having it automatically rolling across the ground to place a curve in the barrier trace, a dispenser 70 for barrier coil 11 has been designed to accommodate the described torsional stress occasioned during coil emplacement. In the specifically illustrated embodiment of the dispenser of this invention as disclosed in FIGS. 12 and 13, a drum 72 is shown open at one end and mounted on a frame 74 having a pair of interconnected sliding skids 76, 78 adapted to be dragged along a desired obstacle trace.

The skids 76, 78 are joined to one another by crossbars 80, 82 (FIG. 13) underlying drum 72, and also at upright terminal ends 84, 86 of the skids which are respectively secured to a fixed bearing support plate 88. The latter is also secured to adjacent ends of a pair of curved handlebars, 90, 92 which are shown disposed in a generally horizontal plane to extend about the closed end 94 of drum 72 and along diametrically opposed sides of drum 72. The handlebars 90, 92 are connected by support rods 96, 98 to the underlying horizontally extending portions of skids 76, 78.

To automatically relieve the torsional stress normally encountered in coil emplacement, the dispenser drum 72 is supported for rotation about a horizontal axis on a pair of rollers, such as at 100, 102 mounted on each skid 76 and 78. Closed end 94 of drum 72 has mounting plate 104 and connected support shaft 106 integrally fixed in coaxial relation to the central axis of the drum 72. Shaft 106 is suitably fixed against longitudinal displacement relative to frame 74 and is fixed in coaxial relation to drum 72 for rotation within a suitable bearing assembly 107 mounted on plate 88 which is secured to upright terminal ends 84, 86 of skids 76, 78.

Figure 6:
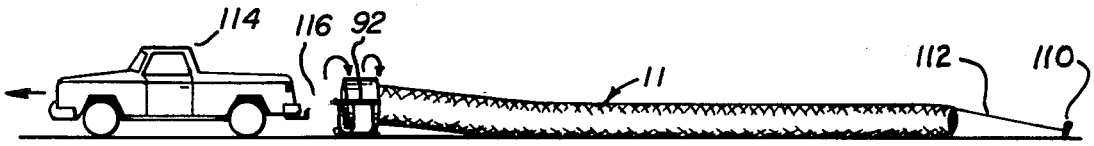
FIG. 6 is a reduced side view of the vehicle, dispenser and deployed coil of FIG. 5.

The coil turn spacer device 52 has a lead length 108 of cable (illustrated in FIG. 12) secured to any suitable fixed object such as ground stake 110 adjacent the exposed open end of drum 72. Another connecting cable 112 is fixed between stake 110 and the end turn of coil 11 at the open end of drum 72 in diametrically opposed relation to lead cable length 108. The dispenser 70 may be suitably attached adjacent the drum closed end 94 to a vehicle, such as that shown at 114 in FIGS. 5 and 6, by tow cable 116 interconnected between vehicle 114 and handlebars 90, 92.

In the specifically illustrated embodiment of dispenser 70, a frame support caster 118 is shown centrally disposed between skids 76, 78 and mounted within a swivel assembly 120 connected to frame 74 by a rod 122 fixed and extending between assembly 120 and plate 88 below bearing assembly 107 of drum 72 at the juncture of terminal ends 84, 86 of skids 76, 78 and the handlebars 90, 92 of dispenser drum 72.

For controlled coil payout, an interior surface of the drum sidewall is preferably provided with radially inwardly extending projections such as at 124 which not only serve as stops to maintain the coil 11 in ready collapsed position within the drum 72 but also effect a frictional drag during deployment as the coil turns slide over the smooth confronting surfaces of the projections 124. It will be understood that the inside drum diameter is dimensioned to be slightly greater than the maximum outside diameter of coil 11 to ensure its being retained in stacked nested condition as a solid cylinder when collapsed and housed within drum 72, as well as to permit ready return of the coil 11 to the drum 72 upon coil recovery for re-use.

Accordingly, with the end of coil 11 at the open end of drum 72 anchored relative to the surface on which the obstacle is to be deployed, the dispenser 70 may then be rapidly moved, for example, by the towing vehicle 114. As dispenser 70 is dragged along a desired obstacle trace, drum 72 is free to rotate under the influence of the erected trailing obstacle to permit rapid installation of a uniformly configured obstruction in a stress-free condition throughout its maximum length along a desired barrier trace without any undesired buckling of the erected barrier intermediate its ends. When fully deployed, the free leading end of coil 11 is suitably fixed upon emerging from drum 72 such as by staking end cables, not shown, similarly to that described above in connection with the trailing end turn of coil 11 to secure the coil 11 in place.

Due to the unique nature of coil 11 featuring the permanent attachment points between coil turns and the described coil turn spacer device, coil 11 is particularly suited to be readily recoverable in precisely nested collapsed condition and housed within its dispenser drum 72 for re-deployment when desired.

While a presently preferred embodiment of this invention has been shown and described, and a preferred embodiment of practicing the same has been illustrated, it is to be understood that the invention is not limited thereto, but may be otherwise variously embodied within the scope of the following claims.

We claim:

1. A barrier coil dispenser comprising a movable frame, a single coil dispensing drum having a cylindrical side wall and an open end, and rotary support means for supporting the drum on the frame, the drum being automatically rotatable about its central axis coincident with the central axis of the coil therein for coil deployment from the drum in synchronized relation to movement of the frame along a desired barrier trace for controlled barrier coil emplacement free of torsional stress and undesired buckling of the erected barrier in trailing relation to the drum.

2. The dispenser of claim 1 wherein the rotary support means comprises roller means mounted on the frame and rotatably supporting the drum.

3. The dispenser of claim 1 wherein the frame includes a pair of skids, and wherein the rotary support means includes a pair of rollers mounted on each skid in spaced aligned relation, the rollers of each pair being rotatable about a common axis in parallel relation to the drum axis and supporting the drum for rotation.

4. The dispenser of claim 1 wherein the drum side wall includes an inside surface having a coil engaging projection adjacent the open end of the drum providing controlled coil payout.

5. The dispenser of claim 1 including dispenser tow means attached to the frame adjacent an end of the drum.

6. The dispenser of claim 1 including a coil extensible and retractable about its central axis, the coil being disposed in retracted collapsed condition within the drum in coaxially aligned relation to the central axis of the drum, the coil having opposite terminal end turns and a plurality of closed intermediate turns of substantially uniform size, each intermediate turn of the coil being permanently fixed at multiple coil attachment points in circumferentially spaced succession, alternately, to adjacent trailing and leading turns of the coil.

7. A barrier coil dispenser comprising a frame, a coil extensible and retractable about its central axis, the coil having opposite terminal end turns and a plurality of closed intermediate turns of substantially uniform size, each intermediate turn of the coil being permanently fixed at multiple coil attachment points in circumferentially spaced succession, alternately, to adjacent trailing and leading turns of the coil, the coil including a coil turn spacer assembly extending longitudinally of the coil in parallel relation to its axis and being secured at interconnecting corresponding points of the coil turns, the spacer assembly having substantially equal lengths between secured interconnecting points of the coil turns, and a coil dispensing drum, the drum having a cylindrical side wall, an open end and an opposite closed end, and rotary support means for supporting the drum on the frame for rotation about the central axis of the drum, the coil being disposed in retracted collapsed condition within the drum in coaxially aligned relation to the central axis of the drum.

8. The dispenser of claim 7 wherein the spacer assembly includes a lead length fixed to a first terminal end turn of the coil adjacent the open end of the drum for securing the coil to a fixed object preliminary to a coil dispensing operation.

9. The dispenser of claim 8 further including a connecting member fixed to said first terminal end turn of the coil in diametrically opposed relation to the spacer assembly for securing said first terminal end turn of the coil to a fixed object preliminary to a coil dispensing operation.

10. The dispenser of claim 7, wherein the lengths of the spacer assembly interconnecting corresponding points of the coil turns are each relatively stiff but movable into a folded position within the coil upon coil collapse.

11. The dispenser of claim 7 wherein the spacer assembly comprises a wire rope cable and fasteners for securing the wire rope cable at corresponding points, respectively, of the coil turns, the material of the wire rope cable providing a memory set in folded position on the interior of the coil for repeated retraction into an interference-free folded position upon coil collapse, and wherein the wire rope cable is encased within an outer plastic jacket.

12. The dispenser of claim 6 wherein the number of coil attachment points of each intermediate turn of the coil is an odd number, and wherein the coil attachment points are equiangularly spaced apart on each intermediate turn of the coil.

13. A combination comprising a barrier coil dispenser including a coil receiving frame having an open end, and a coil extensible and retractable about its central axis, the coil being collapsible and mountable in retracted condition within the dispenser frame, the coil having opposite terminal end turns and a plurality of closed intermediate turns of substantially uniform size, each intermediate turn of the coil being permanently fixed, alternately, to at least one attachment point to adjacent trailing and leading turns of the coil, the coil including a coil turn spacer assembly extending longitudinally of the coil in parallel relation to its axis and being secured at interconnecting corresponding points of the coil turns.

14. The combination of claim 13 wherein the spacer assembly has substantially equal lengths between secured interconnecting points of the coil turns.

15. A barrier coil dispenser comprising a frame, a coil extensible and retractable about its central axis, the coil having opposite terminal end turns and a plurality of closed intermediate turns of substantially uniform size, each intermediate turn of the coil being permanently fixed at multiple coil attachment points in circumferentially spaced succession, alternately, to adjacent trailing and leading turns of the coil, the number of coil attachment points on each intermediate turn of the coil being an odd number, the coil attachment points being equiangularly spaced apart on each intermediate turn of the coil, the coil comprising a continuous strip of coiled material formed of substantially planar metal strip stock having a plurality of closed turns of successive tape segments each angularly offset in the plane of the tape at a uniform bend angle to its trailing segment, the tape segments each being of substantially equal length, a barb cluster being formed on each tape segment midway between its ends, each coil attachment point being located centrally of confronting barb clusters of adjacent coil turns, and a coil dispensing drum, the drum having a cylindrical side wall, an open end and an opposite closed end, and rotary support means for supporting the drum on the frame for rotation about the central axis of the drum, the coil being disposed in retracted collapsed condition within the drum in coaxially aligned relation to the central axis of the drum.

* * * * *